US006152202A

United States Patent [19]

Magid

[11] Patent Number: 6,152,202

[45] Date of Patent: Nov. 28, 2000

[54] COMPARTMENTALIZED HANDBAG HAVING STREAMLINED EXTERIORS

[76] Inventor: Ruth Magid, 6 Wolseley Crescent, Point Piper, N.S.W. 2027, Australia

[21] Appl. No.: 09/362,138

[22] Filed: Jul. 28, 1999

[51] Int. Cl.[7] ..... A45C 3/06

[52] U.S. Cl. ..... 150/112; 150/129

[58] Field of Search ..... 150/100, 112, 150/114, 117, 120, 129

[56] References Cited

U.S. PATENT DOCUMENTS

| | | | |
|---|---|---|---|
| D. 381,506 | 7/1997 | Roeder | D3/245 |
| 1,084,101 | 1/1914 | Nover | 150/112 |
| 1,434,926 | 9/1922 | Stember | 150/114 |
| 2,477,388 | 7/1949 | Moore | 150/120 X |
| 2,646,833 | 7/1953 | Meyers . | |
| 2,675,042 | 4/1954 | Herrera | 150/129 X |
| 3,536,116 | 10/1970 | Margolis . | |
| 4,192,365 | 3/1980 | Siegel | 150/35 |
| 4,811,769 | 3/1989 | Phares | 150/113 |
| 5,046,860 | 9/1991 | Brennan | 383/38 |
| 5,048,582 | 9/1991 | Whitfield | 150/112 |

FOREIGN PATENT DOCUMENTS

| | | | |
|---|---|---|---|
| 827086 | 4/1938 | France | 150/120 |
| 388953 | 7/1932 | United Kingdom | 150/117 |
| 460086 | 1/1937 | United Kingdom | 150/120 |

*Primary Examiner*—Sue A. Weaver

[57] ABSTRACT

A compartmentalized handbag comprises a pair of outer panels which are movable from an open position to a position in close proximity to each other, and wherein each of the panels has an outer surface and an inner surface. One or more object-receiving pockets are formed on one or both inner surfaces and extend interiorly of the panels without creating unsightly bulges on the exterior of the panels. A central pocket assembly may be attachably mounted within the handbag.

4 Claims, 3 Drawing Sheets

COMPARTMENTALIZED HANDBAG HAVING STREAMLINED EXTERIORS

FIELD OF THE INVENTION

This invention relates to handbags and more particularly to compartmentalized handbags. More specifically, this invention relates to compartmentalized handbags having several internal pockets for holding diverse objects without creating unsightly bulges on the outside of the bag thus maintaining a streamlined appearance.

BACKGROUND OF THE INVENTION

Handbags, wallets, pocketbooks and the like have long been used by both men and women. Popular among ladies are handbags, particularly the handbags which are compartmentalized and are fashionable in appearance.

U.S. Pat. No. 2,477,388 discloses a lady's purse or pocketbook which provides specialized compartments and pockets for receiving and holding miscellaneous articles.

U.S. Pat. No. 3,543,825 describes a pocketbook which includes a bellow-type multiple pocket insert and a coin purse, all removably affixed in a cover.

U.S. Pat. No. 4,263,951 discloses an organizer handbag system having multiple handbags and interchangeable components and accessories. These accessories may include a wallet, cosmetic case, key ring, address book and notebook.

U.S. Pat. No. 5,048,582 discloses a compartmentalized handbag which includes several compartments and a directional map which identifies the contents and location of each compartment within the bag.

Other handbags which are representative of the prior art include U.S. Pat. Nos. 4,192,365; 4,250,938; 4,263,951; and 5,535,797.

None of the handbags described in the prior art provide convenient, practical and readily accessible compartments without unsightly bulges and unattractive appearance.

Accordingly, it is an object of the present invention to provide an improved handbag in which numerous internal pockets are formed without creating unsightly bulges on the outside of the bag.

Another object of this invention is the provision of such improved handbag which permits the user to store various items in compartmentalized pockets within the handbag.

Still another object of the present invention is the provision of such improved handbag in which it is unnecessary for the user to rummage through the handbag in order to retrieve certain articles.

Yet another object of the present invention is the provision of such improved handbag in which the user can easily retrieve certain articles.

Another object of the present invention is the provision of an improved handbag in which maximum space is used within the handbag for storing various articles therein without creating unsightly bulges on the exterior surface of the handbag.

The foregoing objects and other features of the present invention will be more fully comprehended from the ensuing detailed description and the accompanying drawings.

SUMMARY OF THE INVENTION

In accordance with this invention, a compartmentalized handbag is provided having a plurality of compartments designed and formed to accommodate diverse objects such as brushes, containers, wallets, glasses, keys, pens, sunglasses, mobile phones, umbrellas and other articles. The handbag comprises a pair of opposed outer panels which are movable from an open position to a position in close proximity to each other. Each of the panels has an outer surface and an inner surface, and one or more pockets are formed on and extend from at least one of the inner surfaces inwardly therefrom. The handbag may also comprises a central pocket assembly attachably mounted within the handbag. The central pocket assembly consists of a center piece separating a pair of inner laminates, the upper ends of which may be closed by a suitable closure means such as a zipper. Since the various article-receiving pockets are formed on the interior linings of the panels and extend inwardly toward the center, the resulting handbag is free of unsightly exterior bulges and as fashionably streamlined in appearance.

BRIEF DESCRIPTION OF THE DRAWINGS

In the drawings, wherein like reference numerals are employed to designate like parts.

DETAILED DESCRIPTION OF THE INVENTION

Figure 1:
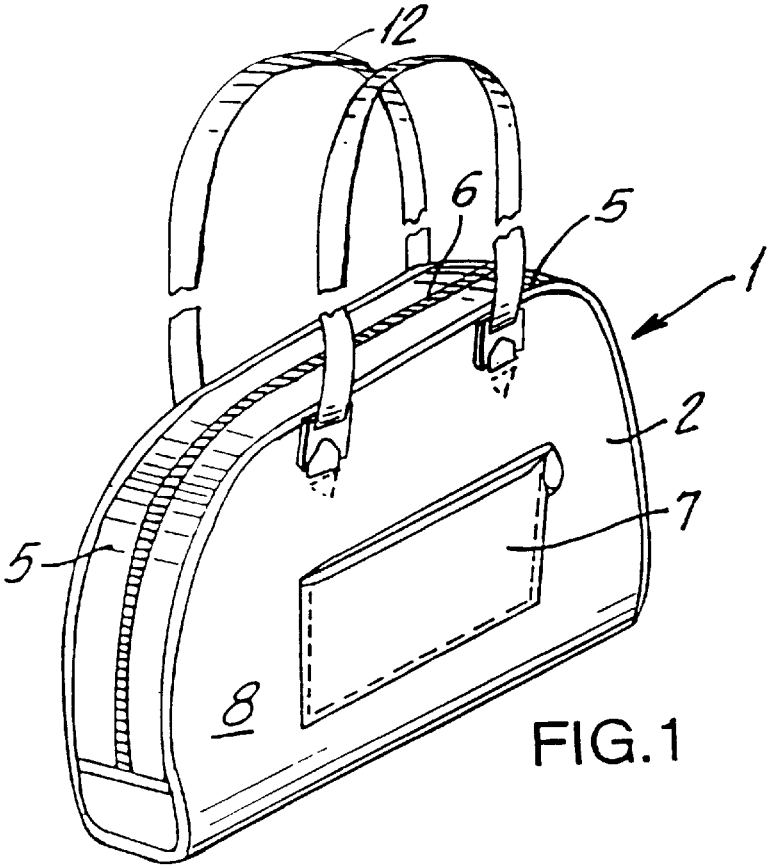
FIG. 1 is a perspective view of a handbag made in accordance with the present invention.
Figure 2:
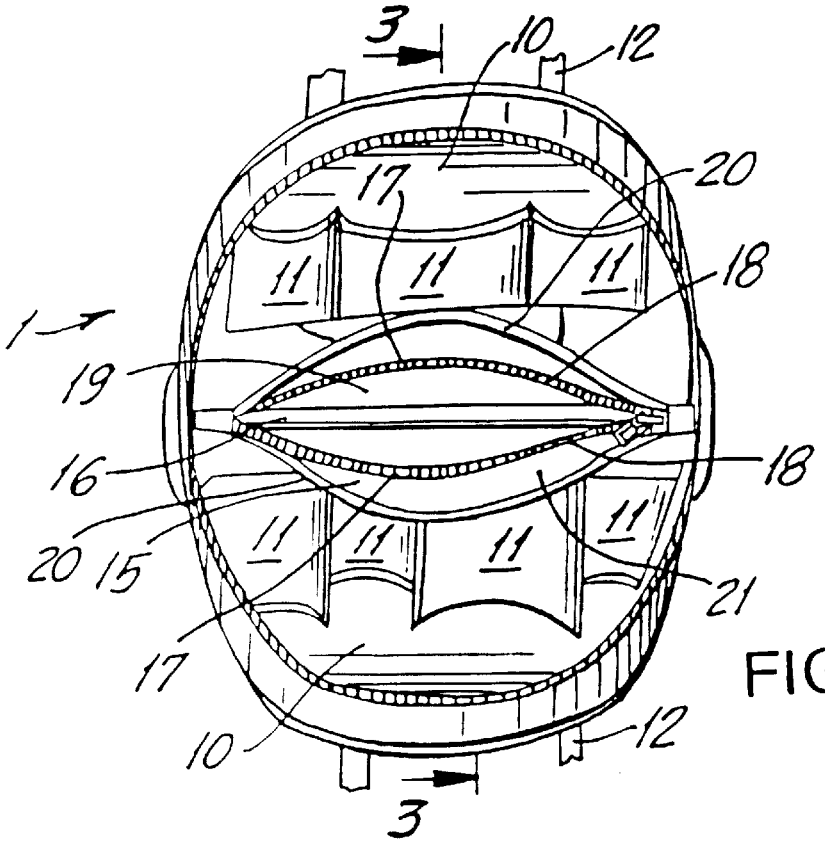
FIG. 2 is a top view of the handbag in its open position.
Figure 1A:
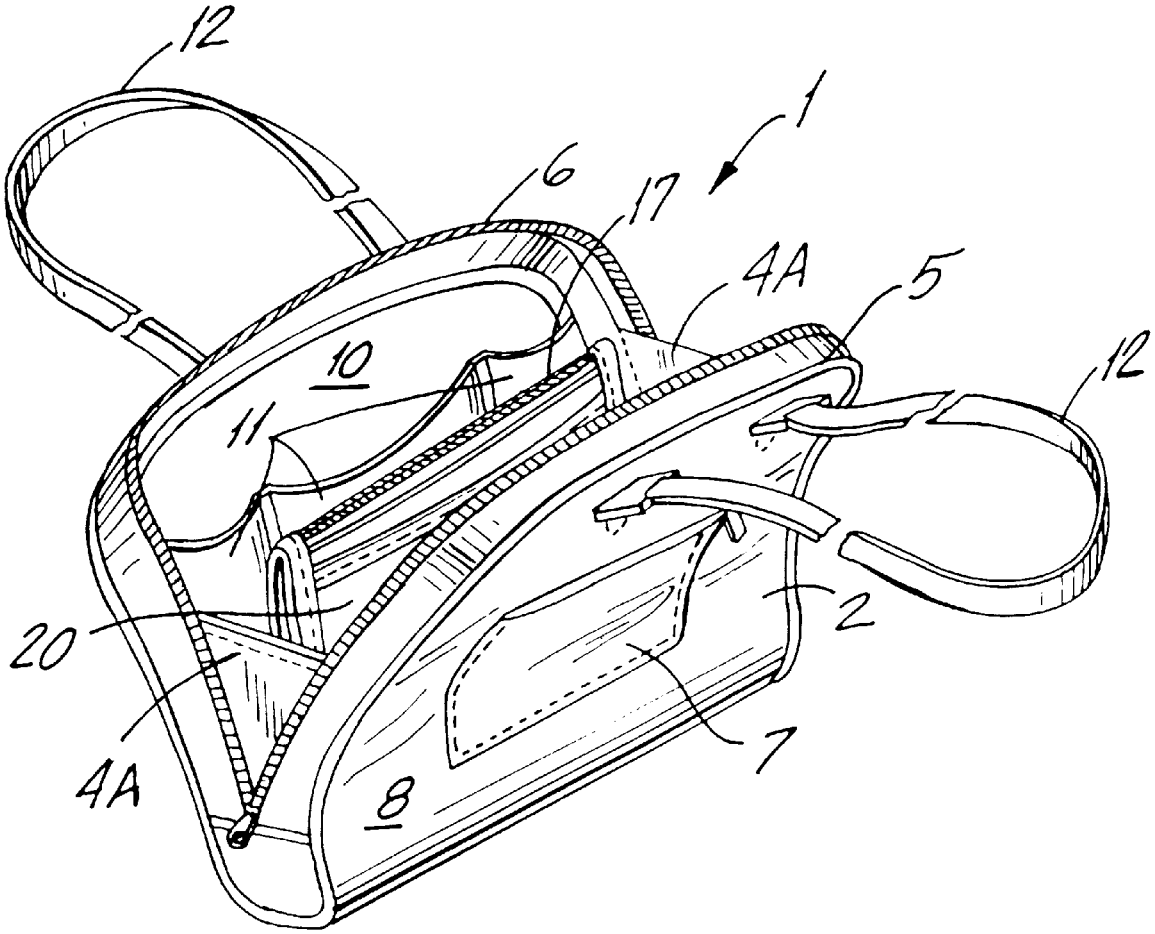
FIG. 1A is another perspective view of the handbag similar to FIG. 1 but wherein the handbag is shown in a partly open position.
Figure 3:
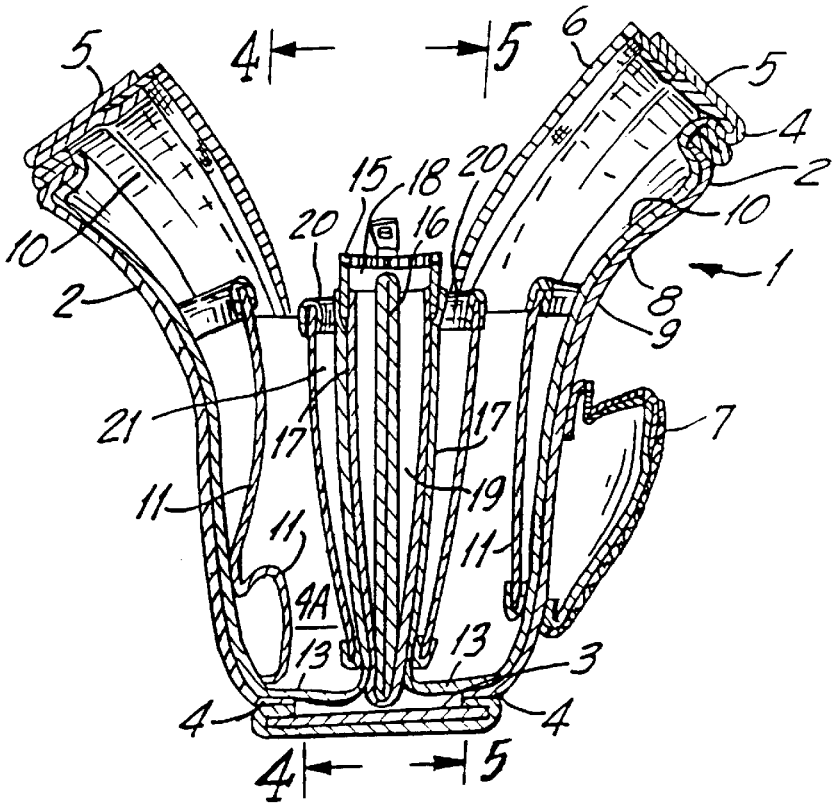
FIG. 3 is a sectional view taken along line 3—3 of FIG. 2.
Figure 4:
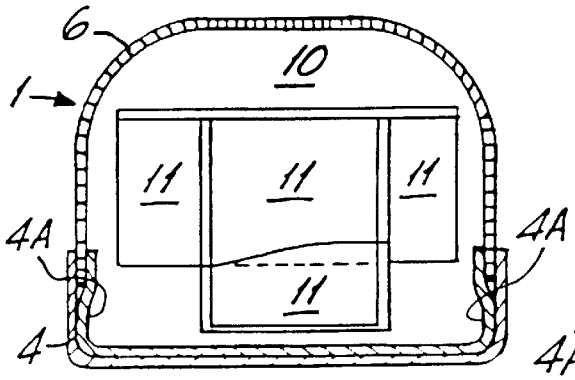
FIG. 4 is a sectional view taken along line 4—4 of FIG. 3.
Figure 5:
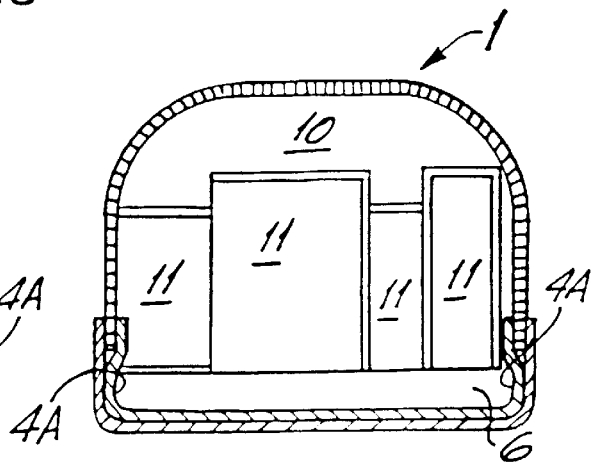
FIG. 5 is a sectional view taken along line 5—5 of FIG. 3.

Referring to the drawings, the handbag 1 of the present invention comprises opposed outer panels 2 connected together at their bottom ends 4 by a stiff support member 3 for a pivotal movement relative to each other. The bottom ends 4 may be secured to gussets 4A as shown in FIG. 1A which secure the bag on either side when the bag is open. The outer panels 2 may be made of any well-known material such as fabric or leather. The top free ends 5 of each outer panel 2 have a zipper assembly 6 which is adapted to be closed in order to close the handbag 1. The zipper assembly 6 is designed to open the bag close to the base and together with the opposed gussets, with each gusset being operatively connected to the inner surface of one of said outer panels 2. This arrangement of the gussets 4A permit the bag to open widely to give the user easy access to the interior. Other closing means may also be used, if desired. Handles 12 may be attached to the panels 2 if desired. An outer pocket 7 may be formed on one of the outer panels 2. However, it will be understood that a similar outer pocket may be formed on the other outer panel 2, or, if desired, the outer pocket 7 may be eliminated altogether.

Each of the outer panels 2 has an outer face 8 and inner face 9. An inner lining 10 may be attached to the inner face 9, if desired. The inner face 9 and/or the inner lining 10 will be referred to hereinafter as an inner surface. Attached to the inner surface (either inner lining 10 or the inner face 9) of both panels 2 is a plurality of pockets 11 facing inwardly from the inner surface. The pockets 11 may be used to store various items such as brushes, bottles, wallets, glasses, keys, pens, sun-glasses, mobile phones, umbrellas, etc. Since the pockets 11 face and extend inwardly from inner surface, they take up very little room within the handbag. In addition, since the pockets 11 face inwardly, they will not bulge outwardly so that the outer face 8 of the handbag remains smooth, streamlined, with no unsightly bulges. It will be understood that the pockets 11 may extend from the inner surface of only one panel rather than both panels.

Centrally mounted within the handbag 1 and attached to the lower extensions 13 of the lining 10 there is provided a central pocket assembly 15 which rests on, or is secured to the support 3. The central pocket assembly 15 comprises a center piece 16 separating a pair of inner laminates 17, the upper ends of which may be closed by a zipper 18 or some other suitable closure means. The center piece 16 and the inner laminates 17 form interior center pockets 19 in side-by-side relationship. Outer laminates 20 spaced from the inner laminates 17 may be provided to form exterior center pockets 21 in the central pocket assembly 15. If desired the entire central pocket assembly 15 may be eliminated. Alternately, either the interior center pockets 19 or the exterior center pockets 21 may be eliminated.

With this invention, full utility is achieved of the inner confines of the handbag since there are a plurality of inner pockets facing inwardly from the inner surfaces of the outer panels 2 and, in addition, there is room for the central pocket assembly 15. The various pockets 11 will receive various items neatly to prevent the items from being loosely distributed within the handbag. In this manner, the items are easily accessible to the user without the user having to rummage through the contents of the handbag in order to retrieve a certain article.

It will thus be seen that the present invention provides an improved handbag in which a plurality of internal pockets are formed without unsightly bulges on the outside of the bag, which permits the user to store various items in compartmentalized pockets within the handbag, in which it is unnecessary for the user to rummage through the handbag in order to retrieve certain articles, in which the user can easily retrieve certain articles, and in which maximum space is used within the handbag for storing various articles therein without creating unsightly bulges in the handbag, hence maintaining streamlined exterior and fashionable appearance.

While the handbag of the present invention has been described with certain degrees of particularity, it is understood that several changes and modifications may be made therein which are nevertheless within the scope of the present invention.

What is claimed is:

1. A handbag comprising a pair of opposed outer panels which are movable from a closed position to a partly open position, each of said panels having an outer surface and an inner surface, a pair of opposed gussets, each gusset being operatively connected to the inner surface of one of said outer panels, at least two pockets in each inner surface of said outer panels, wherein each of said pockets extends inwardly from said inner surface and wherein said pockets are disposed in a non-overlapping position, and internal pocket assembly pivotably mounted centrally in said handbag, said inner pocket assembly comprising a central member disposed transversely in said handbag, and a pair of interior laminates separated by said central member and forming spaced apart interior pockets.

2. A handbag as in claim 1 wherein each of said outer panels has a means for closing and opening said handbag.

3. A handbag as in claim 1 wherein a pocket is mounted on at least one of said outer panels.

4. A handbag as in claim 2 wherein a pocket is mounted on at least one of said outer panels.

* * * * *